United States Patent [19]

Pinkston et al.

[11] 4,378,622

[45] Apr. 5, 1983

[54] METHOD OF MAKING COMPRESSIBLE PRINTING ROLLER

[75] Inventors: Melvin D. Pinkston, Waynesville; Wayne W. Easley, Lake Junaluska, both of N.C.

[73] Assignee: Dayco Corporation, Dayton, Ohio

[21] Appl. No.: 293,764

[22] Filed: Aug. 17, 1981

Related U.S. Application Data

[62] Division of Ser. No. 850,435, Nov. 10, 1977, abandoned.

[51] Int. Cl.[3] ..... B21H 1/14; B21K 1/02

[52] U.S. Cl. ..... 29/148.4 D; 29/450; 29/451; 29/130; 101/376

[58] Field of Search ..... 29/450, 235, 451, 148.4 D; 101/130, 376, 348; 264/49

[56] References Cited

U.S. PATENT DOCUMENTS

| | | | |
|---|---|---|---|
| 1,417,240 | 5/1922 | Fukuda | 29/130 X |
| 1,555,389 | 9/1925 | Stevens | 29/130 X |
| 1,608,206 | 11/1926 | Freedlander | 29/130 |
| 1,778,399 | 10/1930 | Phelps | 29/235 |
| 2,008,772 | 7/1935 | Robertson | 29/235 X |
| 2,450,727 | 10/1948 | Haushalter | 29/234 X |
| 3,035,331 | 5/1962 | Wieman | 29/148.4 D X |
| 3,393,439 | 7/1968 | Shriver | 29/434 X |
| 3,467,009 | 9/1969 | Ross | 29/130 UX |
| 3,705,455 | 12/1972 | Lovett | 29/234 |
| 3,928,521 | 12/1975 | Haren et al. | 264/49 |
| 4,025,685 | 5/1977 | Haren | 101/327 |

*Primary Examiner*—Charlie T. Moon
*Attorney, Agent, or Firm*—Joseph V. Tassone

[57] ABSTRACT

A compressible printing roller and method of making the same are provided wherein such roller comprises a central support, a tubular inner layer carried by the support and made of a microporous rubber material having cavities interconnected by passages, and a tubular outer layer disposed around the inner layer and made of a nonporous polymeric material with the layers cooperating to assure the roller provides optimum contact between the roller and material being coated thereby at comparatively small nip pressures.

1 Claim, 5 Drawing Figures

METHOD OF MAKING COMPRESSIBLE PRINTING ROLLER

CROSS REFERENCE TO RELATED PATENT APPLICATION

This application is a divisional patent application of its copending parent application, Ser. No. 850,435 filed Nov. 10, 1977, now abandoned.

BACKGROUND OF THE INVENTION

Compressible printing rollers have been proposed heretofore and an example of such a roller is illustrated in U.S. Pat. No. 2,054,620. However, a roller of the character disclosed in this patent does not recover with the desired rapidity after compression thereof.

SUMMARY

It is a feature of this invention to provide a printing roller which is capable of rapid recovery after compression thereof during a normal printing operation.

Another feature of this invention is to provide a printing roller of the character mentioned which employs a tubular inner layer made of a microporous rubber material having cavities interconnected by passages defined by particles of hydrated magnesium sulfate leached from cured rubber.

Another feature of this invention is to provide a roller of the character mentioned wherein such roller has a tubular outer layer made of a nonporous polymeric material and such outer layer may be held solely by friction on a compressible tubular inner layer made of a microporous material having cavities interconnected by passages.

Another feature of this invention is to provide a printing roller comprised of a central support, tubular inner layer carried by the support and made of a microporous rubber material having cavities interconnected by passages, and a tubular outer layer disposed around the inner layer and made of a nonporous polymeric material with the layers cooperating to assure the roller provides optimum contact between the roller and material being coated or printed thereby at comparatively small nip pressures.

Another feature of this invention is to provide an improved method of making a printing roller of the character mentioned.

Another feature of this invention is to provide an improved method of making a roller of the character mentioned wherein such roller has a tubular outer layer made of a nonporous polymeric material and such outer layer may be held solely by friction on a tubular inner layer made of a microporous material having cavities interconnected by passages.

Accordingly, it is an object of this invention to provide an improved printing roller and method of making same having one or more of the novel features set forth above or hereinafter shown or described.

Other details, features, objects, uses, and advantages of this invention will become apparent from the embodiments thereof presented in the following specification, claims, and drawing.

BRIEF DESCRIPTION OF THE DRAWING

The accompanying drawing shows present preferred embodiments of this invention, in which.

DESCRIPTION OF ILLUSTRATED EMBODIMENTS

Figure 1:
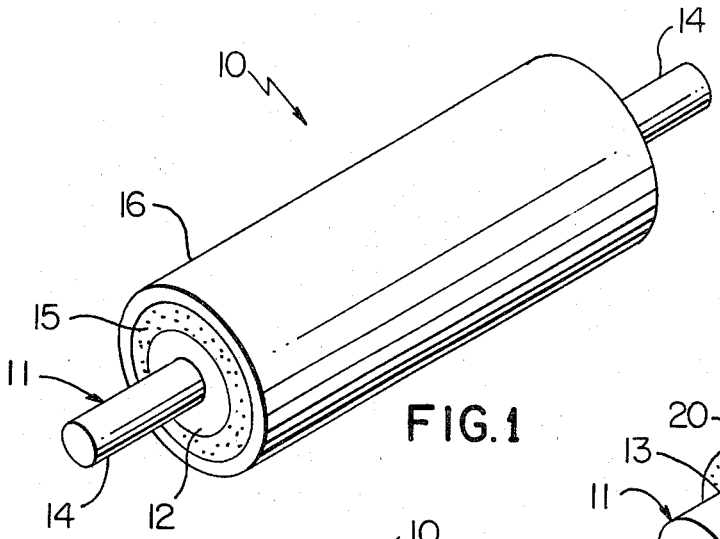
FIG. 1 is a perspective view illustrating one exemplary embodiment of a printing roller of this invention.

Reference is now made to FIG. 1 of the drawing which illustrates one exemplary embodiment of a printing roller of this invention which is designated generally by the reference numeral 10. The roller 10 has cooperating layers (which will be described later) supported on a rigid central support 11 which assures the roller provides optimum contact between such roller and material being coated or printed thereby at comparatively small nip pressures.

Figure 3:
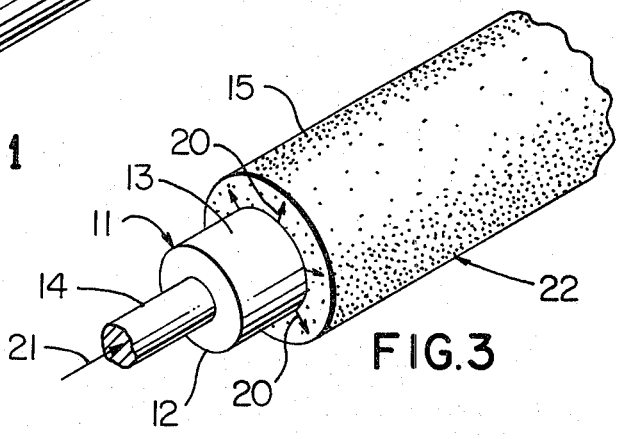
FIG. 3 is a perspective view with certain parts broken away illustrating a method of assembling a tubular inner layer of the roller of FIG. 1 on a central support therefor.

As seen in FIG. 3 the central support 11 comprises a comparatively rigid shaft 12 which is preferably made of metal and extends completely through the roller 10 and the shaft 12 has a right circular cylindrical outside surface 13 and reduced diameter shaft portions 14 extending from opposite ends of such shaft. The reduced diameter end portions 14 are particularly adapted to be supported on anti-friction bearing means such as ball bearings, or the like, and in a manner which is known in the art. The shaft 12 with its reduced diameter ends 14 may be made as a single-piece structure or in a plurality of pieces utilizing any technique known in the art.

The roller 10 has a tubular inner layer 15 carried by the central support 11 and the inner layer 15 is made of a microporous rubber material. The roller 10 also has a tubular outer layer 16 disposed around the inner layer 15 and made of nonporous polymeric material which is preferably made of rubber.

Figure 2:
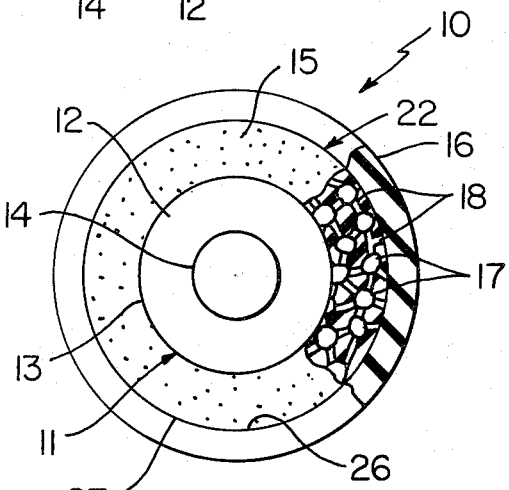
FIG. 2 is an end view of the roller of FIG. 1 with a fragmentary portion thereof broken away and illustrating certain component parts in cross section.

As best seen in FIG. 2 the microporous inner layer 15 is made of a rubber material, as indicated by the cross-hatching in the drawing, having cavities 17 interconnected by passages 18 and although any suitable rubber material may be used to define the layer 16 one example of a material which is preferred is a salt leached microporous rubber made in accordance with the teachings of U.S. Pat. No. 3,928,521. As disclosed in this patent particles of a suitable salt, preferably hydrated magnesium sulfate, are provided by any known means or process and suitably mixed in a polymeric matrix material such as rubber to define a salt loaded rubber matrix material. The loaded rubber matrix material is then cured and leached and during the curing thereof there is a substantially simultaneous liberation of water of crystallization from the hydrated magnesium sulfate which provides a blowing effect and results in the formation of the interconnecting passages 18 between the particles of magnesium sulfate. The particles of magnesium sulfate are then leached out defining cavities 17 in the rubber matrix whereby the microporous rubber material or layer 15 is defined having voids therein comprised of cavities 17 interconnected by passages 18.

As is known in the art, the cured and leached rubber material with the interconnected cavities defined therein is then suitably rinsed to remove any residual magnesium sulfate and residual water is then also removed preferably by air drying. After air drying, the tubular inner layer 15 is formed utilizing any suitable known technique and such layer is preferably in the form of a single-piece sleeve which may be installed in position, essentially as shown in FIG. 3. The voids present in the microporous inner layer 15 are defined by cavities 17 and interconnecting passages 18 as previously mentioned and while the amount of or total volume of voids may vary and be controlled within any suitable amount, preferably the voids represent between 30 to 70% of the total volume of the layer 15.

The tubular outer layer 16 may be made of any suitable polymeric material employed in the art of making printing rollers and as previously mentioned. Preferably a suitable rubber compound is employed and the rubber may be a natural or synthetic rubber. In addition, it will be appreciated that the outer layer is nonporous, i.e., such layer is of solid cross-section throughout free of voids, or the like.

The construction and arrangement of roller 10 with its central support 11 which is comparatively rigid, tubular microporous inner layer 15 of the character described, and nonporous polymeric outer layer 16 provide a combination of components, particularly the layers 15 and 16 thereof, which cooperate to assure that the overall roller 10 provides optimum contact between such roller 10 and material being coated or printed thereby; and, yet with this optimum contact being achieved at comparatively small nip pressures when comparing such nip pressures with other printing rollers proposed heretofore.

The microporous inner layer 15 may comprise varying amounts of the total thickness or volume defined by both layers 15 and 16. Preferably the inner layer 15 comprises between 2 and 80 percent of the combined radial thickness of the layers 15 and 16.

The printing roller 10 may be made utilizing any technique or method known in the art and preferably such roller is made by providing a central support shaft 11 of the character described which is made of a rigid material such as metal and then disposing the tubular inner layer 15 therearound. The tubular inner layer 15 is preferably disposed around the central support 11 by radially expanding such layer or sleeve 15 with such radial expansion being indicated by arrows 20 in FIG. 3. This radial expansion is achieved by relatively moving the tubular inner layer 15 and the support 11 with such relative movement being illustrated in FIG. 3 by holding the tubular inner layer or sleeve 15 stationary and moving the support 11 therewithin as indicated by the arrow 21 to thereby define an assembly which will be designated by the reference numeral 22 in FIG. 3.

Figure 4:
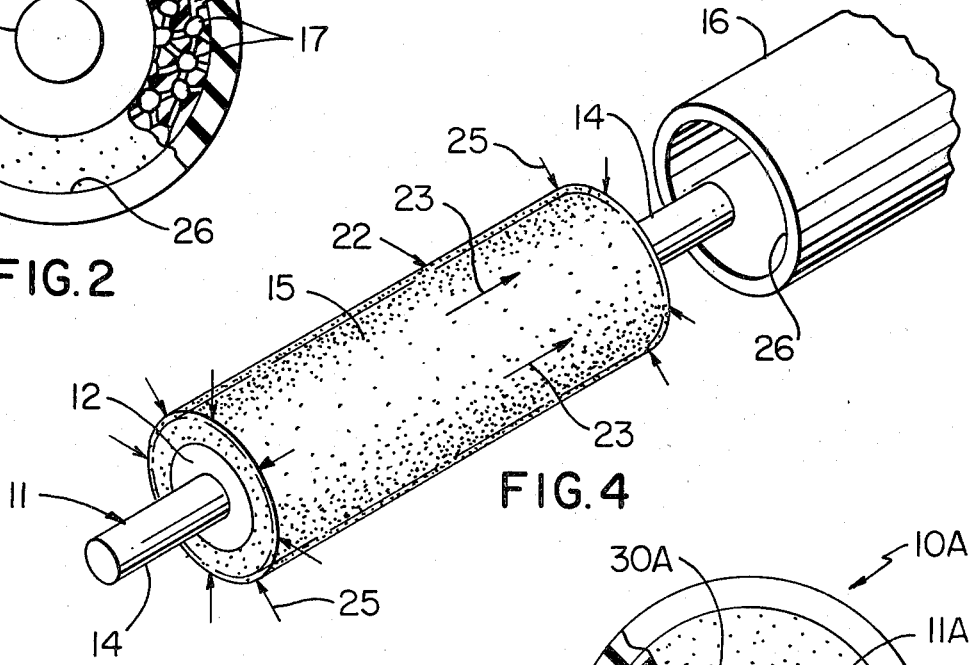
FIG. 4 is a fragmentary perspective view illustrating the assembly as defined in FIG. 3 being further disposed within a tubular outer layer to complete the printing roller of FIG. 1.

The tubular outer layer 16 is then disposed around the assembly 22 as illustrated in FIG. 4 by relative movement of the assembly 22 and tubular outer layer 16 and such relative movement is illustrated in FIG. 4 by holding sleeve 16 stationary and moving assembly 22 therewithin as indicated by arrows 23 in FIG. 4. During the placement of the tubular outer layer 16 around the assembly 22 the inner layer is compressed utilizing any suitable compressing means known in the art and such means is indicated schematically at opposite ends of the tubular inner layer 15 of assembly 22 in FIG. 4 by radially inwardly projecting arrows 25.

The compressing means 25 may be in the form of a comparatively thin walled radially reduceable tubular metal sleeve tool which may be placed around assembly 22 and reduced so that its outside diameter is smaller than the inside diameter 26 of the tubular outer layer 16. Once the assembly 22 is inserted within the tubular outer layer 16 the sleeve tool is axially slid from between the assembly 22 and once sliding movement of such tool commences the sleeve or layer 15 expands firmly against the cylindrical inside surface 26 providing a tight friction fit between layer 15 and 16 as shown at 27 in FIG. 2.

It will also be appreciated that instead of employing a sleeve like tool to install the tubular outer layer 16 in position such outer layer may be simply installed by holding the assembly 22 stationary and axially sliding the sleeve 16 over the assembly 22 by relative movement of said assembly 22 and sleeve 16 whereby sleeve 16 also serves as compressing means 25; and, during such relative movement the tubular inner layer 15 of the assembly 22 is compressed radially inwardly as the layer 16 is moved in position. This technique allows outer layer 16 to be installed in position to complete its roller 10 in the printing shop within a minimum of down time for its associated printing apparatus.

The friction fit shown at 27 is sufficient to hold layer 16 on layer 15. Similarly, the roller 10 may be provided with a friction fit between its tubular inner layer 15 and support 11 whereby the component layers 15–16 of the printing roller 10 may be held in position solely by friction. However, it will be appreciated that, if desired, components of the roller of this invention may be fixed together by suitable adhesive means as will now be described in connection with the embodiment of the printing roller of this invention illustrated in FIG. 5 and now to be described.

Figure 5:
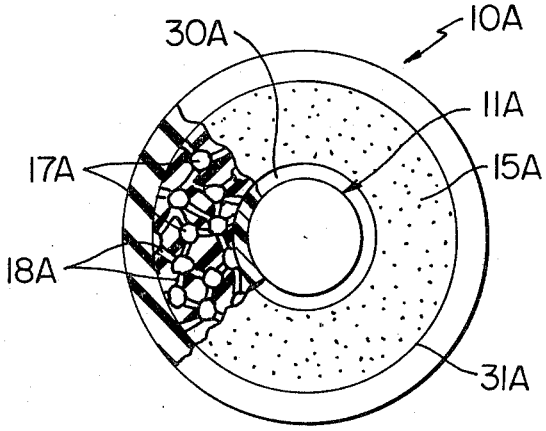
FIG. 5 is a view similar to FIG. 2 illustrating another exemplary embodiment of a printing roller of this invention.

The exemplary embodiment of the printing roller illustrated in FIG. 5 of the drawing is very similar to the printing roller 10; therefore, such printing roller will be designated by the reference numeral 10A and component parts thereof which are similar to corresponding parts of the printing roller 10 will be designated in the drawing by the same reference numerals as in the printing roller 10, whether or not such parts are mentioned in the specification, followed by the letter designation A and not described again in detail.

The main differences between the printing roller 10A and the printing roller 10 are a central support 11A without reduced diameter end portions, adhesive means 30A bonding inner layer 15A to central support 11A and adhesive means 31A bonding inner layer 15A to outer layer 16A. The adhesive means 30A is in the form of a polymeric sleeve 30A disposed between support 11A and the inner layer 15A which has cavities 17A interconnected by passages 18A. The polymeric sleeve 30A has its inside surface bonded to support 11A and its outside surface bonded to layer 16A. The adhesive means 31A is in the form of a suitable adhesive film which serves to bond the nonporous rubber outer layer 16A to its compressible layer 15A.

The printing roller 10A may be made and assembled essentially as described in connection with the roller 10 and such description will not be repeated. The printing roller 10A with its rigid support 11A and cooperating layers 15A and 16A also operates with optimum contact between such roller and material being coated or printed thereby and at comparatively small nip pressures.

While present exemplary embodiments of this invention, and methods of practicing the same, have been illustrated and described, it will be recognized that this invention may be otherwise variously embodied and practiced within the scope of the following claims.

What is claimed is:

1. A method of making a printing roller comprising the steps of, providing a central support made of a comparatively rigid material, forming a tubular inner layer of a salt-leached microporous rubber material that has voids therein comprising between 30 and 70% of the total volume of said inner layer and defined by cavities interconnected by passages, disposing said tubular inner layer of microporous rubber material around said central support so that said inner layer is under radial expansion and is secured to said central support solely by the resulting friction fit therewith, and placing a polymeric tubular outer layer around said inner layer in such a manner that said inner layer is under compression by said outer layer whereby said outer layer is secured to said inner layer solely by the resulting friction fit therewith, said layers cooperating to define said printing roller and assure said roller provides optimum contact between said roll and material being coated thereby at comparatively small nip pressures, said disposing step comprising the step of forcing said central support within said tubular inner layer upon relatively moving said central support and tubular inner layer towards each other and thereby causing said radial expansion of said tubular inner layer around said central support and the frictionally holding of said inner layer thereagainst, said placing step comprising the step of partially compressing said inner layer radially inwardly and relatively moving said outer layer around said inner layer during said partial compression such that upon release thereof said inner layer expands radially against said outer layer so that said outer layer is held firmly in position against said inner layer solely by the resulting frictional engagement between said inner layer and said outer layer, said partially compressing step being achieved solely by relatively axially moving said outer layer over said inner layer.

* * * * *